US008820826B2

(12) United States Patent
Dickey et al.

(10) Patent No.: US 8,820,826 B2
(45) **Date of Patent: *Sep. 2, 2014**

(54) TABLE AND SEATING APPARATUS

(75) Inventors: Christopher C. Dickey, West St. Paul, MN (US); Kendall A. Kragenbring, Becker, MN (US)

(73) Assignee: Sico Incorporated, Edina, MN (US)

( * ) Notice: Subject to any disclaimer, the term of this patent is extended or adjusted under 35 U.S.C. 154(b) by 163 days.

This patent is subject to a terminal disclaimer.

(21) Appl. No.: 13/477,900

(22) Filed: May 22, 2012

(65) Prior Publication Data

US 2013/0313868 A1 Nov. 28, 2013

Related U.S. Application Data

(63) Continuation of application No. 12/557,268, filed on Sep. 10, 2009, now Pat. No. 8,182,032.

(51) Int. Cl.
*A47B 85/04* (2006.01)

(52) U.S. Cl.
USPC ..... 297/124; 297/121; 297/158.4

(58) Field of Classification Search
USPC ..... 297/119, 121, 124, 158.2, 158.4, 159.1
See application file for complete search history.

(56) References Cited

U.S. PATENT DOCUMENTS

| | | | |
|---|---|---|---|
| 822,182 | A | 5/1906 | Cassel |
| 1,015,230 | A | 1/1912 | Jacob |
| 1,026,140 | A | 5/1912 | Bauer et al. |
| 1,339,232 | A | 5/1920 | St. John et al. |
| 1,370,952 | A | 3/1921 | Danielson |
| 1,457,582 | A | 6/1923 | Lewandoski |
| 1,622,327 | A | 3/1927 | Livingood |
| 1,652,100 | A | 12/1927 | Eastburn |
| 1,823,484 | A | 9/1931 | Blumenthal |
| 1,860,291 | A | 5/1932 | Majcher |
| 1,924,945 | A | 8/1933 | Klotz |
| 2,030,195 | A | 2/1936 | Breese |
| 2,321,177 | A | 6/1943 | Blossom |
| 2,353,892 | A | 7/1944 | Higgins |
| D152,784 | S | 2/1949 | Higgins |
| 2,521,160 | A | 9/1950 | Green |
| 2,621,710 | A | 12/1952 | Miller |
| 2,702,585 | A | 2/1955 | Wilson |
| 2,717,631 | A | 9/1955 | Howe |
| 2,721,778 | A | 10/1955 | Wilson |
| 2,730,417 | A | 1/1956 | Mitchell |
| 2,739,860 | A | 3/1956 | Wilson |
| 2,766,812 | A | 10/1956 | Schrader |

(Continued)

OTHER PUBLICATIONS

International Search Report and Written Opinion mailed Dec. 13, 2010 for International Application No. PCT/US2010/048071.

*Primary Examiner* — Peter Brown
(74) *Attorney, Agent, or Firm* — Merchant & Gould PC

(57) ABSTRACT

A rolling table and seating system includes a first assembly folding between a first position with the first assembly forming a seat bottom, and a second storage position. A second assembly moves between a first position with the second assembly forming a table and a second position at which the second assembly forms a seat back complementary to the seat bottom. First linkages fold the first assembly and include a leg supporting the seat bottom at the first position, and lift and pivot the leg at the second storage position. Second linkages fold the second assembly and include a leg supporting the table at the first position and move the leg to a position with a lower end of the leg laterally outward from an upper end of the leg.

15 Claims, 14 Drawing Sheets

(56) References Cited

U.S. PATENT DOCUMENTS

| | | | |
|---|---|---|---|
| 2,771,937 | A | 11/1956 | Wilson |
| 2,782,075 | A | 2/1957 | Fagan |
| 2,805,707 | A | 9/1957 | Schoeppner |
| RE24,454 | E | 4/1958 | Wilson |
| 2,934,386 | A | 4/1960 | Shore |
| 2,969,245 | A | 1/1961 | Wilson |
| 3,028,197 | A | 4/1962 | Wilson |
| 3,055,705 | A | 9/1962 | Wilson |
| D194,038 | S | 11/1962 | Preston |
| 3,075,809 | A | 1/1963 | Wilson |
| 3,099,480 | A | 7/1963 | Wilson |
| 3,099,481 | A | 7/1963 | Bue |
| 3,101,064 | A | 8/1963 | Kanzelberger et al. |
| 3,109,678 | A | 11/1963 | Wilson |
| 3,212,463 | A | 10/1965 | Anderson et al. |
| 3,245,363 | A | 4/1966 | Amthor, Jr. et al. |
| 3,266,840 | A | 8/1966 | D'Estrube |
| 3,337,262 | A | 8/1967 | Katzfey et al. |
| D211,886 | S | 8/1968 | Benjamin |
| 3,411,823 | A | 11/1968 | Bue |
| 3,477,760 | A | 11/1969 | Bue |
| 3,511,532 | A | 5/1970 | Tringali et al. |
| 3,536,356 | A | 10/1970 | Wilson |
| 3,580,632 | A | 5/1971 | Seymour |
| 3,715,143 | A | 2/1973 | Gerken et al. |
| 3,877,086 | A | 4/1975 | Bue et al. |
| 3,900,905 | A | 8/1975 | Johnson et al. |
| 3,999,245 | A | 12/1976 | Bue et al. |
| 4,052,100 | A | 10/1977 | Nikitits et al. |
| 4,070,057 | A | 1/1978 | Jones |
| 4,100,858 | A | 7/1978 | Bue et al. |
| D250,151 | S | 11/1978 | Pingel |
| 4,131,311 | A | 12/1978 | Nikitits |
| 4,133,271 | A | 1/1979 | Carlson |
| 4,136,622 | A | 1/1979 | Bue et al. |
| 4,223,945 | A | 9/1980 | Nikitits |
| D257,623 | S | 12/1980 | Bue et al. |
| 4,249,773 | A | 2/1981 | Giambalvo |
| 4,337,670 | A | 7/1982 | Carlson |
| 4,449,263 | A | 5/1984 | Wilson et al. |
| 4,592,105 | A | 6/1986 | McNamara |
| 4,596,196 | A | 6/1986 | Gunter et al. |
| 4,606,575 | A | 8/1986 | Kodet |
| 4,653,804 | A | 3/1987 | Yoo et al. |
| 4,700,987 | A | 10/1987 | Sraka et al. |
| 4,793,011 | A | 12/1988 | Eve |
| 4,826,244 | A | 5/1989 | Choi |
| 4,883,314 | A | 11/1989 | Sakong |
| 4,885,813 | A | 12/1989 | McNamara |
| 4,932,333 | A | 6/1990 | Jensen et al. |
| 5,029,938 | A | 7/1991 | Song |
| D327,178 | S | 6/1992 | Ryaa |
| D327,779 | S | 7/1992 | Jensen et al. |
| D330,127 | S | 10/1992 | Song |
| 5,349,789 | A | 9/1994 | Andert et al. |
| 5,446,932 | A | 9/1995 | Voorhis |
| D369,913 | S | 5/1996 | Noll |
| 5,522,097 | A | 6/1996 | Ciccotelli |
| 5,652,978 | A | 8/1997 | Wiig |
| 5,683,135 | A | 11/1997 | Williams |
| 5,794,540 | A | 8/1998 | Dombrowski et al. |
| 5,906,015 | A | 5/1999 | Hilger et al. |
| D413,734 | S | 9/1999 | Bue |
| 6,065,802 | A | 5/2000 | Bue |
| 6,189,283 | B1 | 2/2001 | Bentley et al. |
| 6,212,710 | B1 | 4/2001 | Jones |
| 6,254,178 | B1 | 7/2001 | Bue |
| 6,386,628 | B2 | 5/2002 | Bue |
| 6,772,699 | B1 | 8/2004 | Elliott |
| 6,779,208 | B2 | 8/2004 | Lim et al. |
| 7,159,940 | B1 | 1/2007 | Atkins |
| D573,360 | S | 7/2008 | Bue et al. |
| 7,611,193 | B2 | 11/2009 | Bue et al. |
| 2005/0242633 | A1 | 11/2005 | Frobose et al. |

TABLE AND SEATING APPARATUS

BACKGROUND OF THE INVENTION

1. Field of the Invention

The present invention is directed to a folding table and seating apparatus and in particular to a folding table and seating apparatus with a narrow table that may be folded for storage and folded to form a seatback with an associated complementary bench.

2. Description of the Prior Art

Folding table and seating devices are well known and have become common place in large multipurpose use spaces that are utilized at various times as dining rooms, meeting halls, lecture rooms and for other uses. In such spaces, it is often desirable that multipurpose furniture be used. This furniture normally includes tables, chairs, benches and/or stools and related equipment, or table and seat combinations. Such furniture provides added utility if it folds so that the assemblies have a smaller profile for storage and requires a storage base. Folding tables that have accompanying stools and benches are well known and provide seating and table space, but require a relatively small amount of storage space. Examples of folding and seating devices include: U.S. Pat. No. 2,771,937, U.S. Pat. No. 3,075,809, U.S. Pat. No. 3,099,480 and U.S. Pat. No. 6,386,628, all assigned to SICO Inc., of Edina, Minn., the Assignee of the present application.

Although such tables have been successful in providing folding furniture with associated seating, still further improvements are possible. A combination table and seating system is marketed under the trade name ConverTable by SICO, Inc. and includes a folding table and seating assembly with a bench and a table top. In addition, the table top folds to a position wherein the table top forms a seatback to the bench. The assembly also folds to a compact storage position wherein the seatback and seat bottom extends substantially vertically to provide for a high degree of nesting, thereby requiring less storage space. The ConverTable table system also provides for edge to edge mounting when configured as a bench and table so that a wide table surface is formed by the joined unit with benches extending along both sides of the tabletop. The bench may include a folding leg that retracts in a storage position and is raised so that the frame is supported on casters. The assembly may be easily transported from one location to another when supported only on the casters. Such a table and seating system provides great benefits as there is relatively small footprint for storage with a high degree of nesting. Moreover, the units provide for a table and seating unit as well as seating with a seat back. Such flexibility provides great utility.

Although the ConverTable system and other systems have been very successful in providing multi-use furniture, further improvements are possible. To improve the footprint, the framework dimensions could be configured to maximize stability while reducing the framework footprint and minimizing any potential tripping hazards. Moreover, folding should be controlled and eliminate the possibility of instability due to over folding, while minimizing the risks of pinching fingers for operators. The linkage should also be simple and reliable to facilitate movement of each of the assemblies between the various positions. The framework for such a table and seating system should provide for sturdy and inexpensive manufacture and also be lightweight so that the system may be easily moved and/or lifted.

It can be seen that a new and improved folding table and seating system is needed. Such a system should provide for safe and easy conversion between a table and seating configuration wherein the system has a bench and complementary tabletop, a seating configuration wherein the system forms a bench and a complementary seat back and a storage position wherein the elements are folded to a substantially vertical position for a high degree of nesting. Moreover, such a system should maximize stability while minimizing the footprint. The system should also provide for safe controlled movement and folding between the different configurations. The present invention addresses these as well as other problems associated with folding tables and seating systems.

SUMMARY OF THE INVENTION

The present invention is directed to a table and seating apparatus that is foldable between multiple use positions providing different configurations. In a first configuration, the system is utilized as a narrow table with a tabletop having an associated bench. In a second configuration, the system is utilized as a seat with a seat bottom and seat back. In a third configuration, the system sets up for nesting for compact storage with the seatback and table portion folded to extend substantially vertically.

The table and seating system includes a framework at each end of the assembly. Each of the frameworks has a bottom portion extending transverse to the longitudinal direction of the table and seat and risers extending upward. A first riser extends to an underside of the tabletop and a second riser extends to a lower height to support the seat. The tabletop and seat both include retractable legs that engage the floor in one position and are retracted when moved to a second position. Each of the frameworks generally is supported on a set of casters for easy transport in the storage configuration. The frame is configured so that the lateral portion extending beyond the first riser below the tabletop does not extend as far as the end of a lateral portion of the frame extending outward below the seat. Such a configuration reduces any potential tripping hazard while maintaining superior stability and providing a wide base of support in all configurations.

The tabletop includes a tabletop linkage that retracts the legs below the tabletop. When the tabletop is in a folded position as a seatback or for storage, the tabletop leg at each framework is lifted off the ground and extends above the lower portions of the frame. The legs extend with the lower portion extending slightly outward at approximately a ten degree angle to act as a guard and as a visual alert so that the that the tripping hazard from the frame extending outward is minimized. The folding linkage includes a slot in the tabletop frame attached to the bottom of the tabletop element forming a sliding link, and folding links extending between the leg and associated frame.

In addition, the seat includes a linkage folding the legs upward and the seat portion to a substantially vertical position against the tabletop and seatback. The seat linkage includes a link extending between the seat riser and the leg and pivots at the frame and at the top of the leg. Moreover, a stop is positioned against the pivot at the seat and frame to prevent instability from over folding of the seat and tabletop beyond the intended use positions.

In one embodiment, the seat portion includes a center leg while the end legs are formed as a tube that extends as a continuous element from one leg to the other with the upper horizontal portion of the tube acting as the pivot axis for the legs. The assemblies are also fitted with attachments so that the frames below the tabletop may be joined to adjacent assemblies to form an extended tabletop having twice the width of a single assembly and with bench seating along both sides.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring to the drawings, wherein like reference letters and numerals indicate corresponding structure throughout the several views.

DETAILED DESCRIPTION OF THE PREFERRED EMBODIMENT

Figure 1:
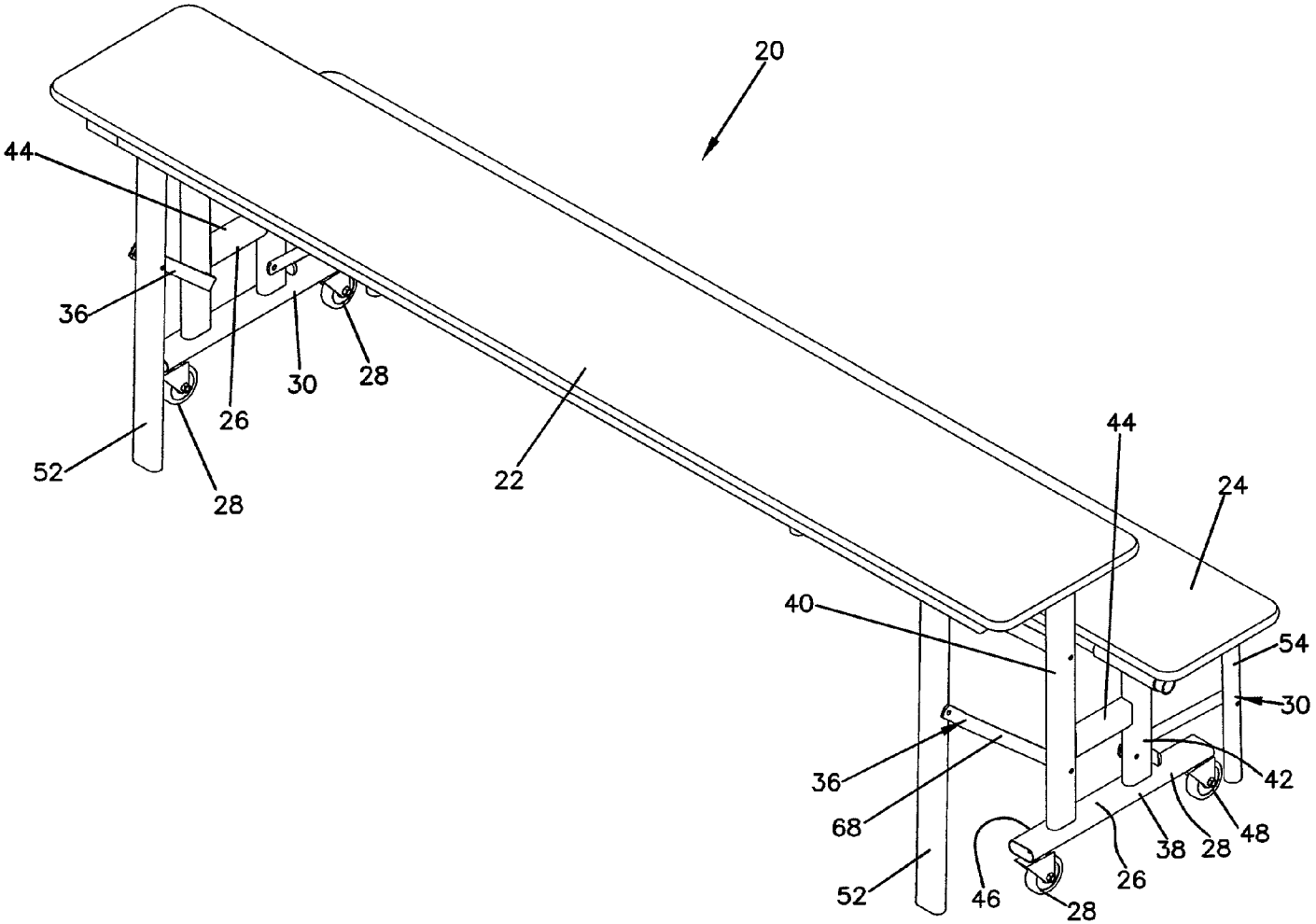
FIG. 1 is a perspective view of a folding table and seating apparatus according to the principles of the present invention configured as a table and bench.
Figure 2:
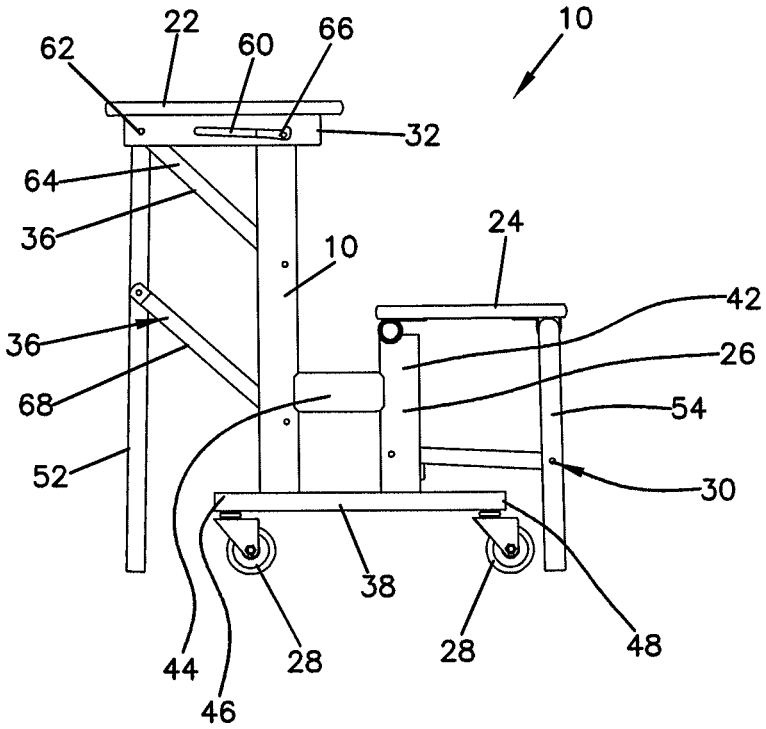
FIG. 2 is an end view of the folding table and seating apparatus shown in FIG. 1.
Figure 3:
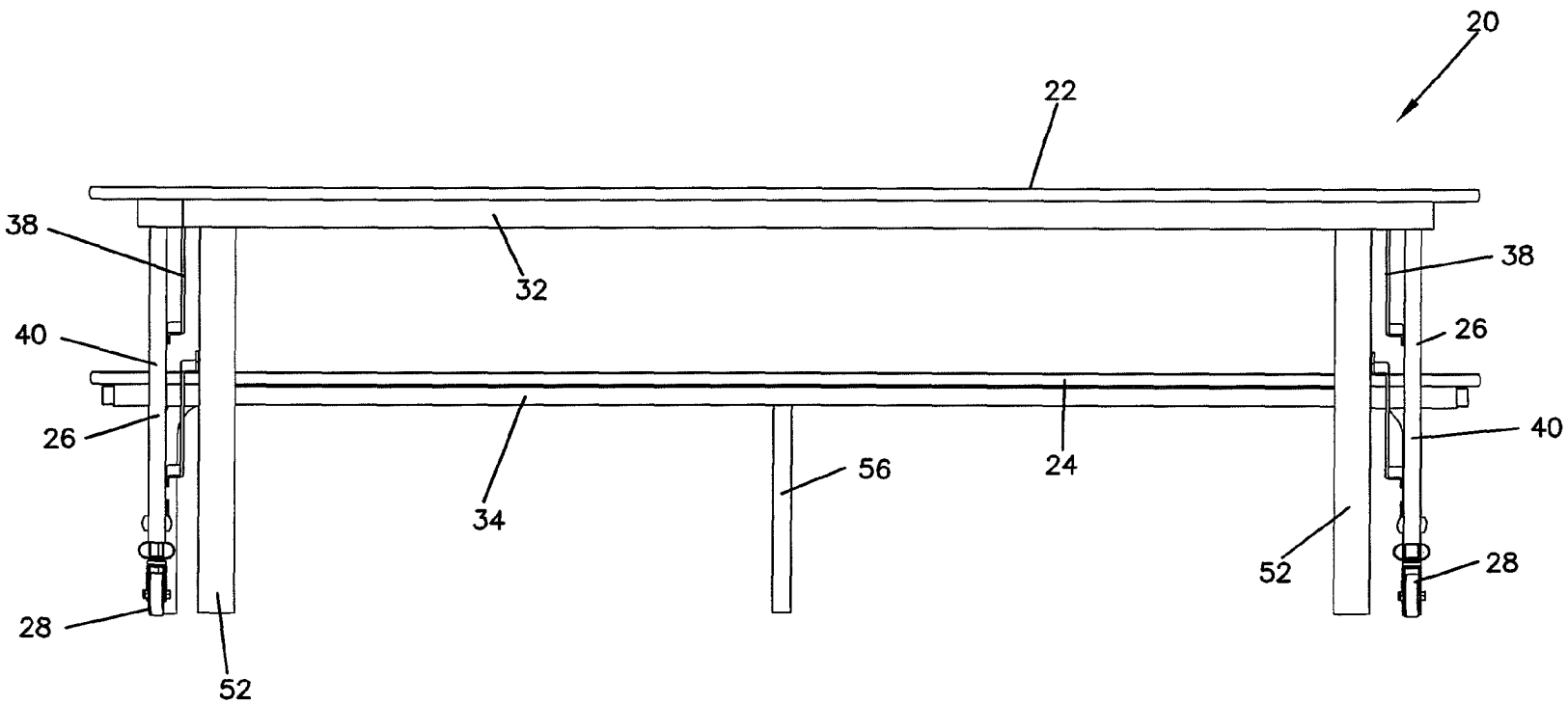
FIG. 3 is a side view of the folding table and seating apparatus shown in FIG. 1.
Figure 4:
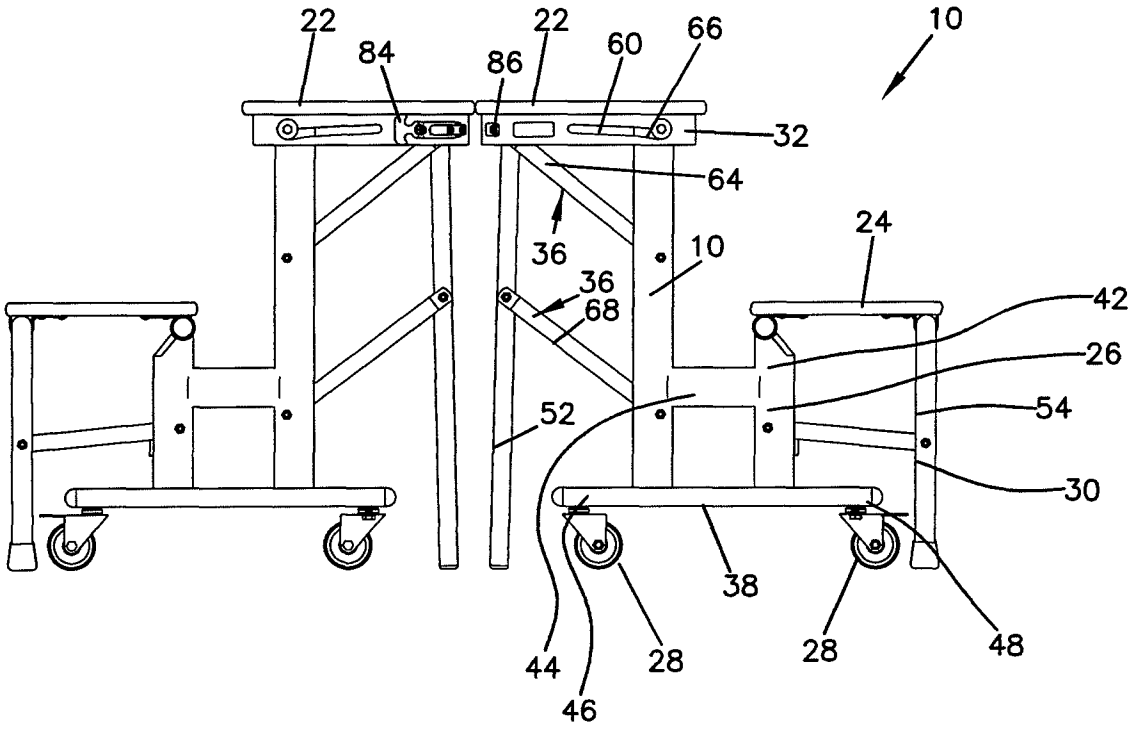
FIG. 4 is an end view of the folding table and seating apparatus shown in FIG. 1 joined with another table and seating apparatus to form a wider table having opposed benches.
Figure 5:
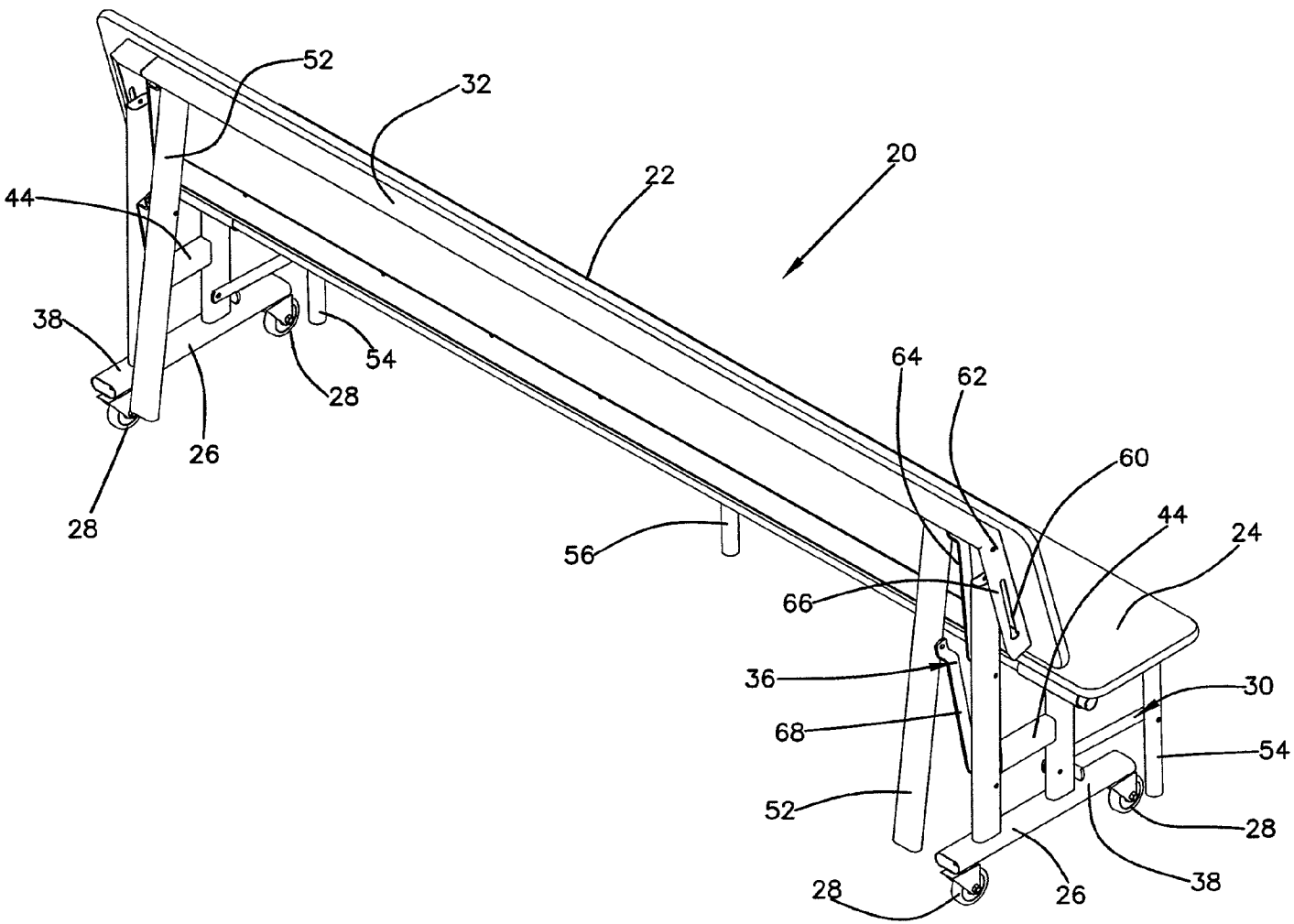
FIG. 5 is a perspective view of the folding table and seating apparatus shown in FIG. 1 configured as a seat with a seat back.
Figure 6:
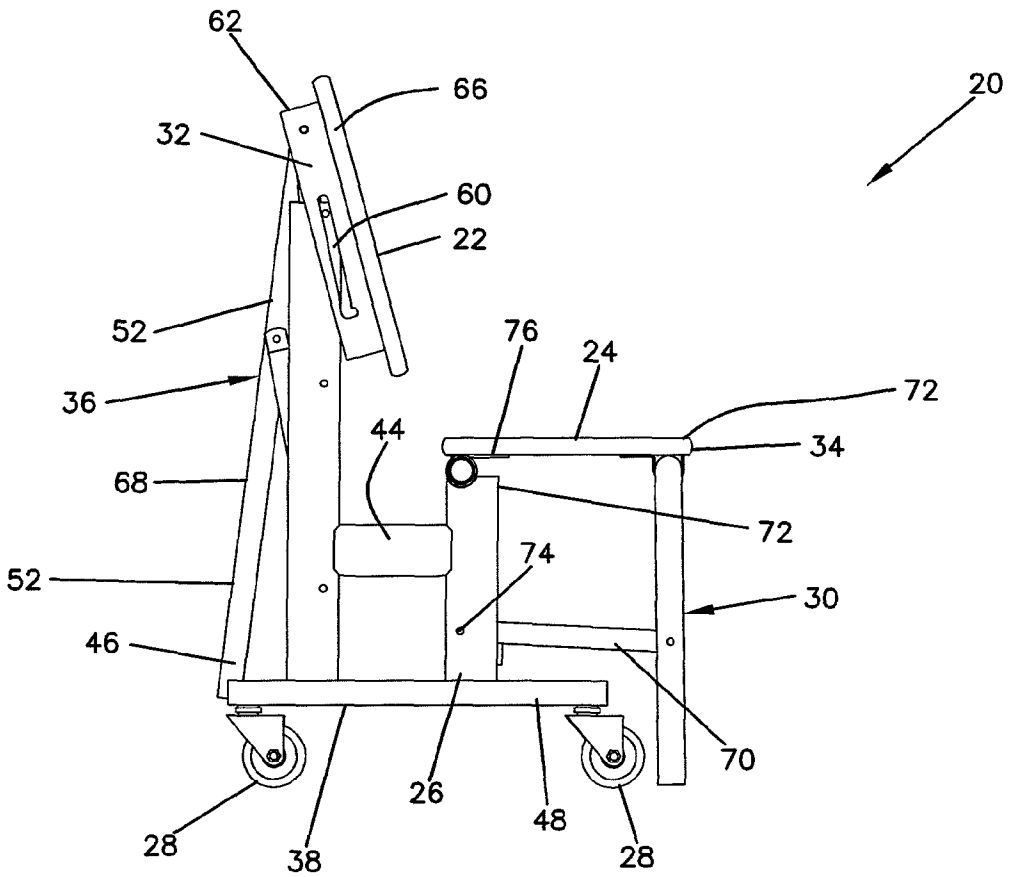
FIG. 6 is an end view of the folding table and seating apparatus shown in FIG. 5.
Figure 7:
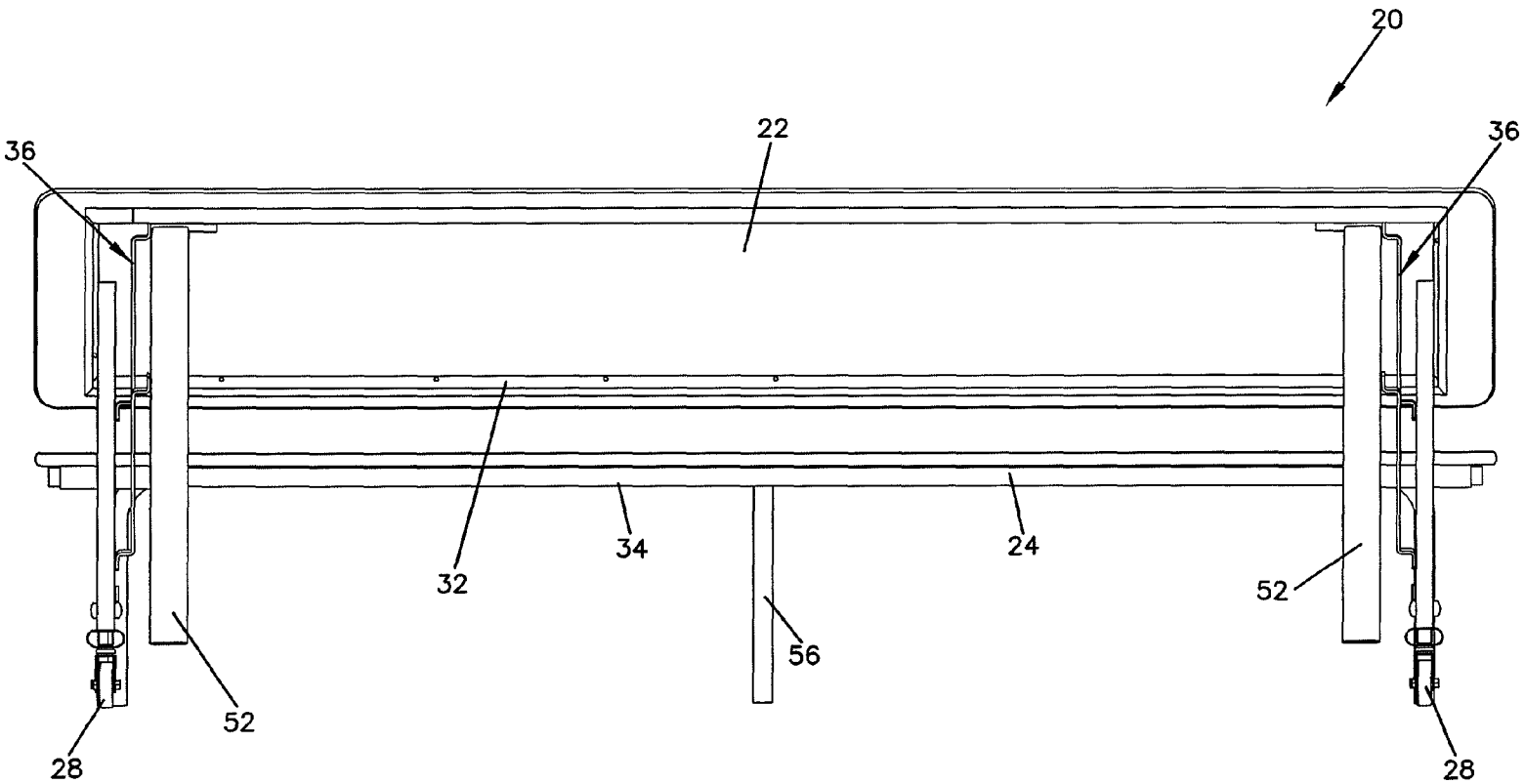
FIG. 7 is a side view of the folding table and seating apparatus shown in FIG. 5.
Figure 8:
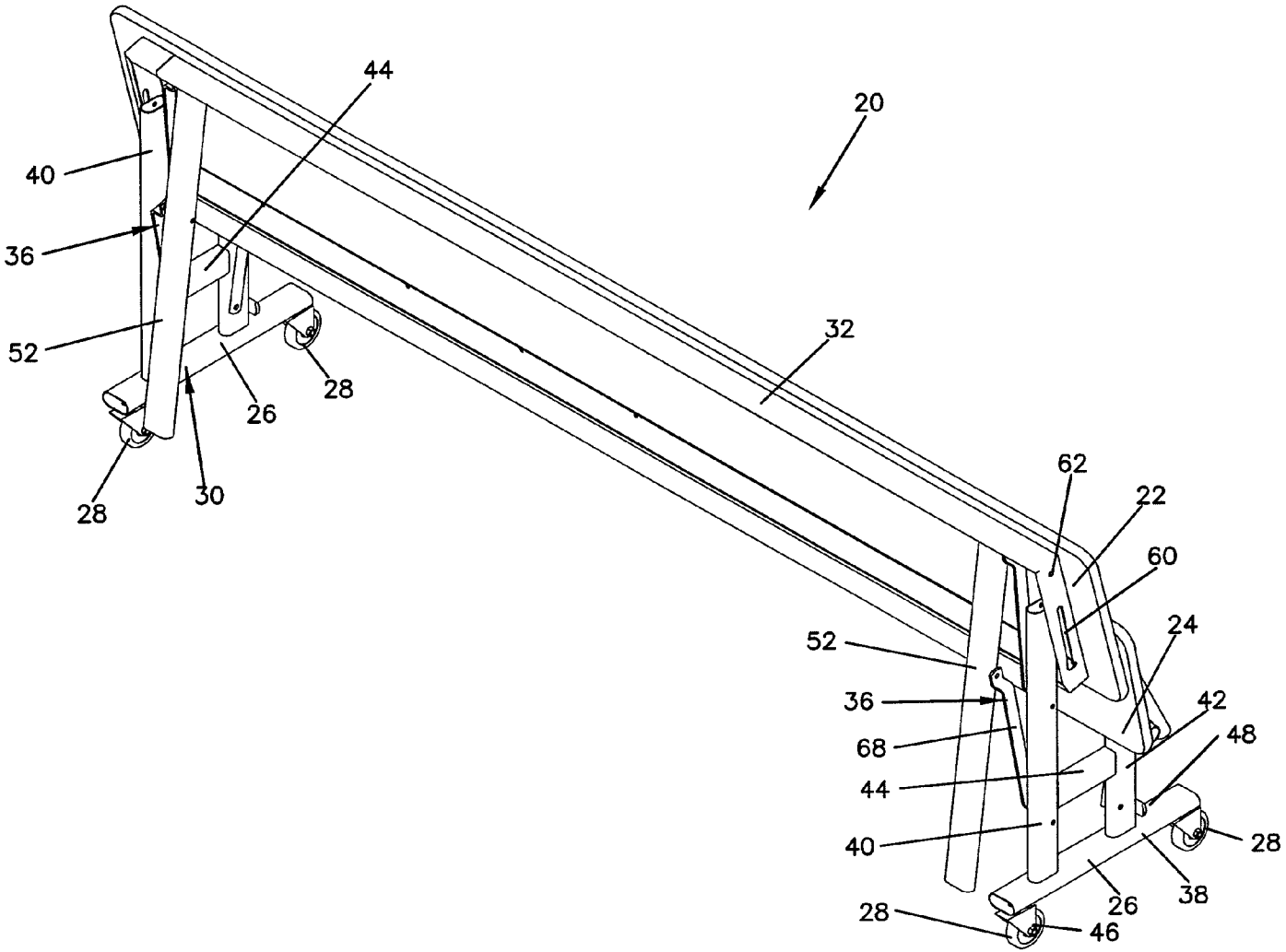
FIG. 8 is a perspective view of the folding table and seating apparatus shown in FIG. 1 configured for nested storage.
Figure 9:
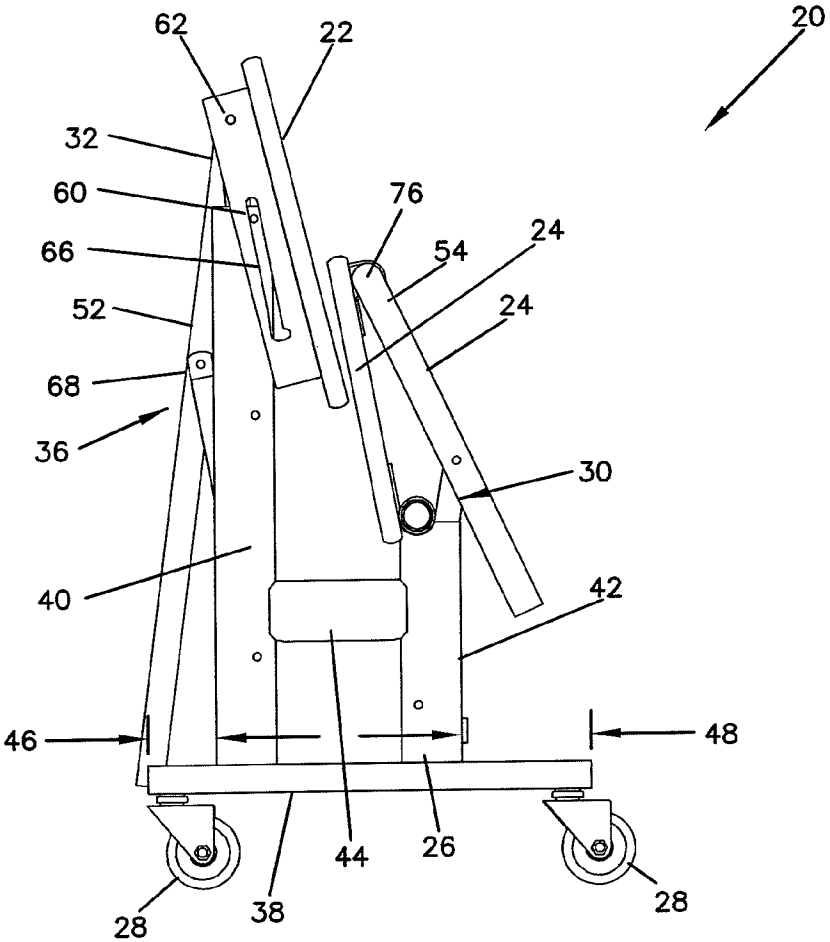
FIG. 9 is an end view of the folding table and seating apparatus shown in FIG. 8.
Figure 10:
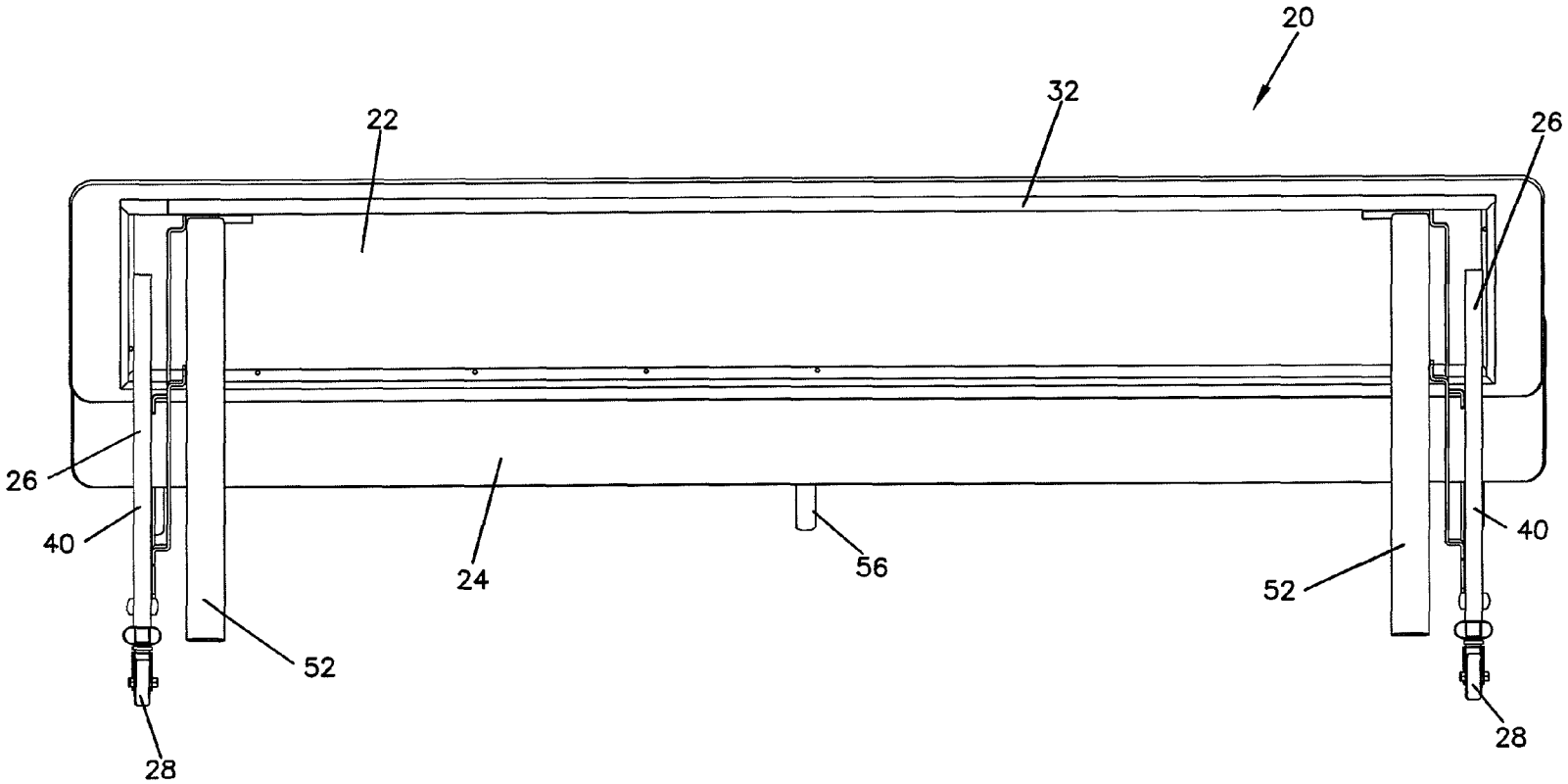
FIG. 10 is a side view of the folding table and seating apparatus shown in FIG. 8.
Figure 11:
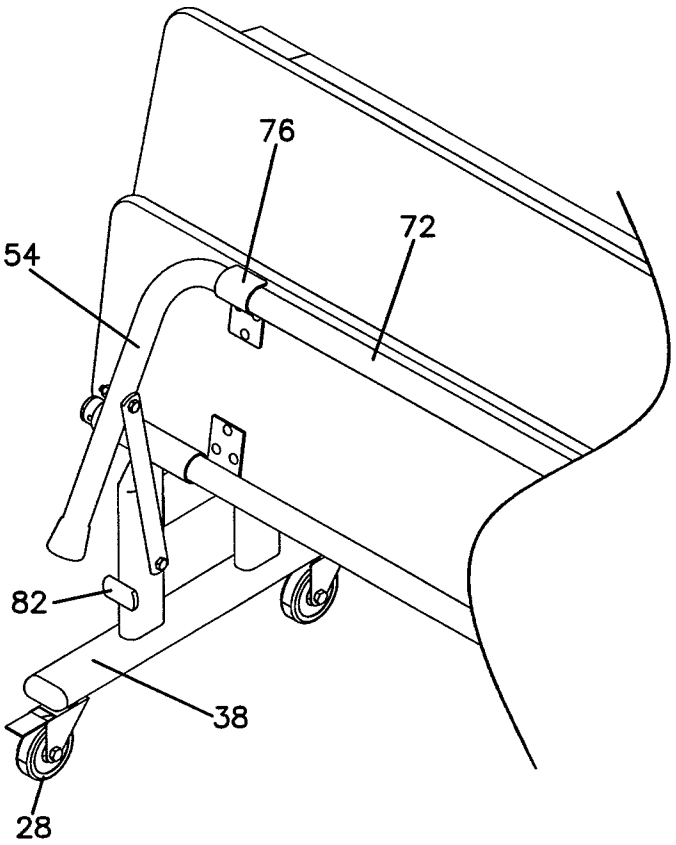
FIG. 11 is a perspective detail view of the folding table and seating apparatus shown in FIG. 8 showing the seat leg and pivot.

Referring now to the drawings, and in particular to FIGS. 1, 5 and 8, there is shown a table and seating system, generally designated 20. The table and seating system 20 may be configured as a table with a bench as shown in FIGS. 1-4, as a bench with a seatback as shown in FIGS. 5-7 and configured to be nested for storage as shown in FIGS. 8-11. The table and seating system 20 generally includes a tabletop and seatback portion 22 that functions as either a tabletop or seatback depending upon the configuration, a seat bottom 24 and support frame 26 at each end of the table and seating system 20. The frame 26 is supported on conventional casters 28 for easy transport of the table and seating system 20 from location to location. The folding of the seat bottom 24 is facilitated by a first linkage 30 while the tabletop and seat back 26 is folded by a second linkage 36. The tabletop and seatback 22 includes a support frame 32 on the underside of the tabletop and seatback portion 22 while the underside of the seat bottom includes a seat bottom frame 34.

The frame assemblies 26 at each end of the table and seating system 20 each include a generally horizontal bottom portion 38, a riser 40 extending upward to the table and the seatback 22. A second lower seat riser 42 extends up to the underside of the seat bottom 24. A horizontal member 44 extends between the risers 40 and 42 to provide added structural integrity and rigidity between the risers 40 and 42. The frame bottom 38 includes a first portion 46 extending laterally outward beyond the riser 40 and a second portion 48 extending laterally outward in an opposite direction beyond the seat riser 42. In the embodiment shown, the relative dimensions of the first and second portions 46 and 48 of the frame bottom 38 are configured so that the second portion 48 of the frame bottom 38 is longer than the first portion 46 of the frame bottom 38, as shown in FIGS. 2, 4, 6 and 9. Such a configuration provides for superior stability and a wide base for safely supporting the table and seating system 20 in all configurations. Moreover, the configuration reduces potential tripping hazards, as explained further hereinafter.

Figure 13:
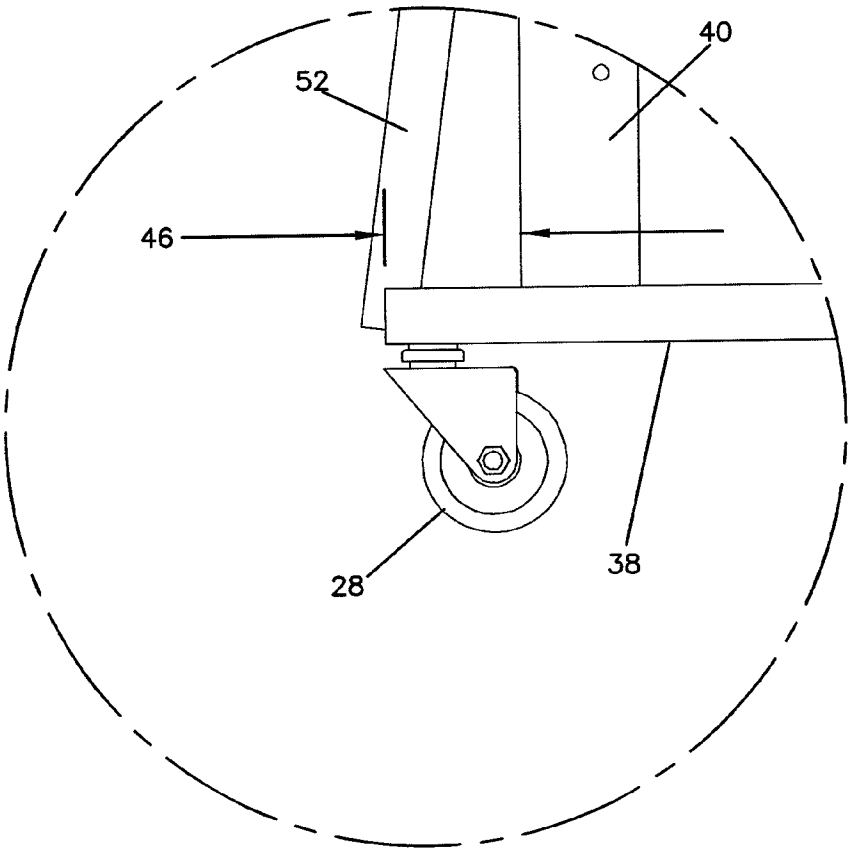
FIG. 13 is a detail view of a leg extending over the frame for the folding table and seating apparatus shown in FIG. 5.

Referring to FIGS. 1-4, when configured as a tabletop and bench seat, the table and seating system 20 includes seat legs 54 and a center seat leg 56 engaging the ground and supporting the seat bottom 24 and two tabletop legs 52, one at each framework assembly 26, engaging the ground and supporting the tabletop 22. Each of the tabletop legs 52 mounts to the tabletop frame 32 about a pivot 62 and also includes an upper link 64 and lower leg link 68 connecting the leg 52 to the riser 40 of the frame 26. Moreover, the second linkage 36 includes a slot 60 formed in the tabletop frame with a slider 66 at a top of the riser 40 sliding along and within the slot 60 to facilitate movement between a position wherein the tabletop and seatback portion 22 is substantially vertical, such as when used for storage or as a seatback, and a position wherein the tabletop and seatback portion 22 is horizontal, such as when used as a tabletop. It can be appreciated that as shown in FIGS. 5, 6, 8 and 9, and most clearly in detail in FIG. 13, when the tabletop and seatback 22 is substantially vertical such as in the storage position or when forming a seatback, the legs 52 extend substantially over the first portion 46 of the frame bottom 38. In this manner, the tripping hazard is reduced as the legs 52 form a guard as well as providing a visual warning of the presence of the bottom frame 38 extending outward into a potential walking path. The legs 52 are generally configured so that the lower portion extends slightly outward beyond the upper portion at an angle of approximately ten degrees. However, other smaller and greater angles between five and twenty degrees have also been found to provide superior performance.

The seat bottom 24 is supported on the first linkage 30, which provides for movement of the seat bottom 24 between a use position and a storage position independently of movement of the second linkage 36. The first linkage 30 includes seat legs 54 and a link 70 between the legs 54 and the riser portion 42 of the frame. In a preferred embodiment, the legs are formed of a single tube that has a horizontal section that acts as a pivot axis 72 between the seat bottom 24 and the legs 54, as shown most clearly in FIG. 11. The seat bottom 24 pivots about the seat riser 42 at an upper pivot 74 as well as on the leg 54 at a pivot 76. The seat bottom 24 folds between the use position wherein the seat bottom 24 is substantially horizontal, as shown in FIGS. 1-4, and the generally vertical storage position shown in FIGS. 8-11. It can be appreciated that the seat bottom 24 substantially rests against the tabletop 22 in the storage position for improved nesting with other systems 20. When configure for storage, the table and seating systems 20 provide for a high degree of nesting while maintaining superior stability.

As shown most clearly in FIG. 4, the table and seating system 20 may be joined in an edge-to-edge configuration along the edge each tabletop 22 opposite the seat bottom 24 to form an extended tabletop with benches along opposite sides of the tabletop frame 32. Conventional flexible connectors include a male element 84 mounted to an underside of the tabletop 22 and a complementary receiver 86 mounted to the tabletop of an adjacent table and seating system 20. The connectors 84 and 86 releasably retain the tabletops 22 of the two table and seating systems 20 pressed against one another. The ability to join the individual table and seating systems into a larger table with greater tabletop surface area and benches along both sides provides added flexibility and utility to the system 20.

Figure 12:
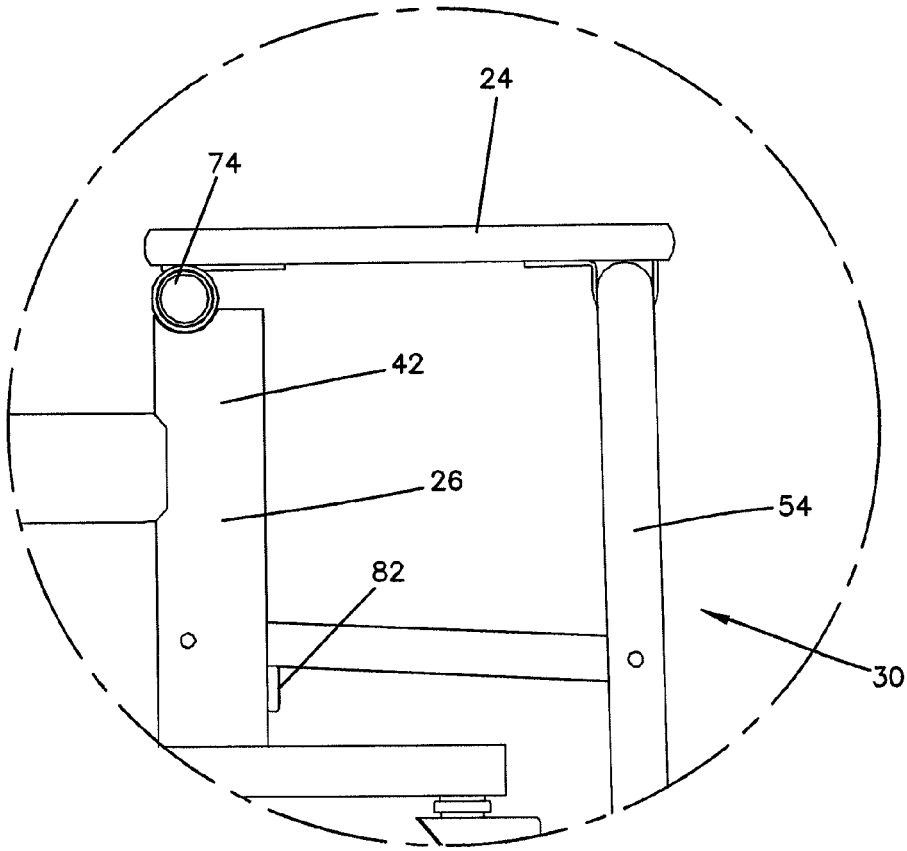
FIG. 12 is a detail view of a stop for the folding linkage for the folding table and seating apparatus shown in FIG. 5.

As shown in FIG. 12, the first linkage 30 includes a stop 82 engaging the link 70 that prevents the seat bottom 24 from folding beyond the normal use positions and over folding of the tabletop and seat back 22 relative to the seat bottom 24. Therefore, the stop 82 prevents instability and possible shifting of the seat back 22 and seat bottom 24 if pressure is applied at the wrong point. Although the stop is shown mounted on the riser 42 and is engaged by the link 70, other stops having different configurations may be utilized.

Figure 14:
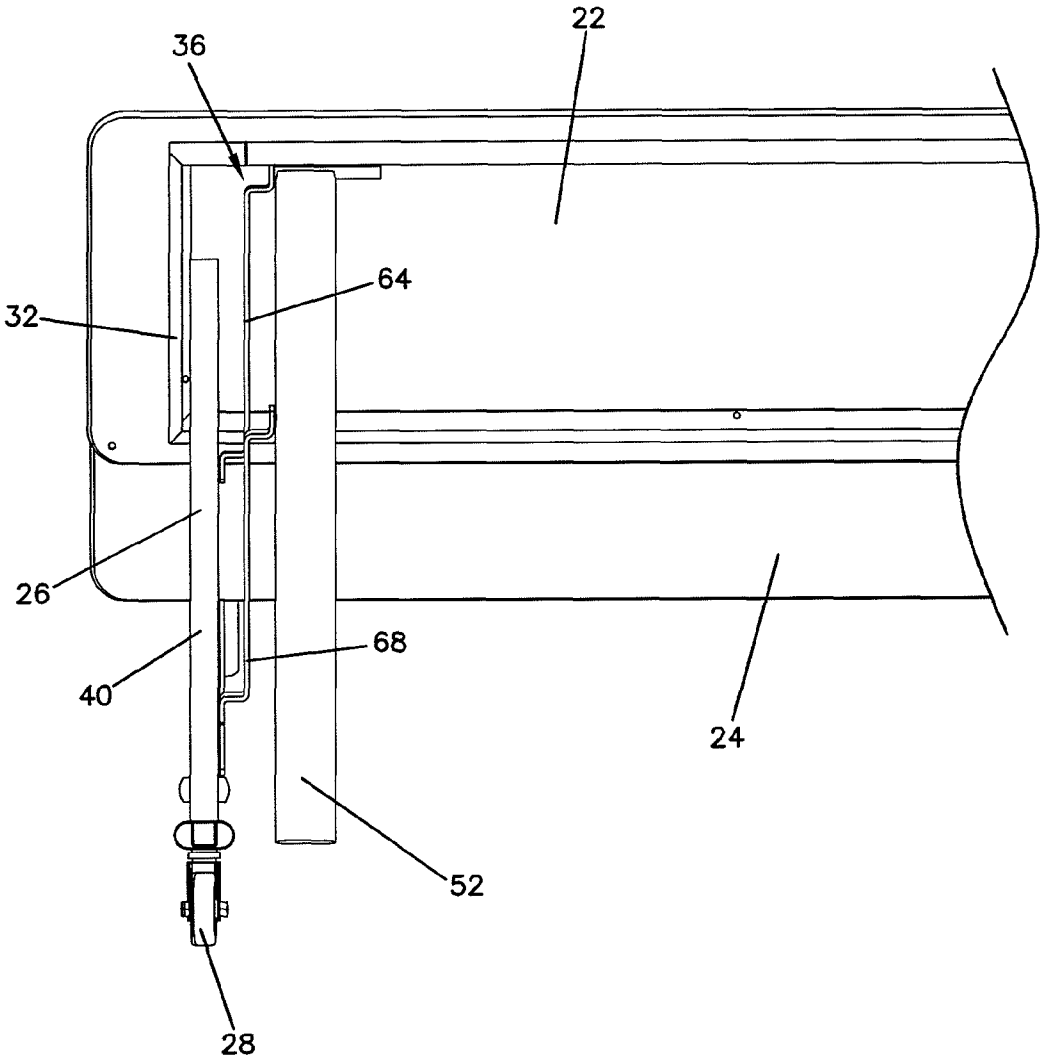
FIG. 14 is a detail view of the folding linkage and offset links for the folding table and seating apparatus shown in FIG. 1.

Referring now to FIG. 14, it can be seen that the links 64 and 68 have offset portions so that there is improved nesting while the possibility of pinching a worker's fingers is decreased. The offset also provides for folding of the various links of the second linkage 36 closer together for improved nesting as opposed to having elements stacked upon one another within the same path of motion.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A table and seating apparatus, comprising:

a first assembly folding between a first position wherein the first assembly forms a seat bottom, and a second storage position;

a second assembly movable between a first position wherein the second assembly forms a table and a second position wherein the second assembly forms a seat back complementary to the seat bottom;

a frame proximate each end of the table and seating apparatus having laterally spaced apart first and second upright frame portions, the first upright frame portion supporting the first assembly and the second upright frame portion supporting the second assembly, a lower frame portion extending laterally outward including a first lateral portion extending toward a first side beyond the first upright frame portion, and a second lateral portion extending toward a second side beyond the second upright frame portion;

rolling devices mounted to and supporting the frame;

at least one first linkage folding the first assembly, wherein the first folding linkage includes a leg supporting the seat bottom at the first position, and lifts and folds the leg at the second storage position;

at least one second linkage folding the second assembly, wherein the second linkage includes a leg supporting the table at the first position and wherein the second linkage moves the leg to a position wherein a lower end of the leg is laterally outward from an upper end of the leg.

2. A table and seating apparatus according to claim 1, wherein the leg of the second linkage forms a barrier to the second lateral portion of the frame.

3. A table and seating apparatus according to claim 1, wherein the first lateral portion is longer than the second lateral portion.

4. A table and seating apparatus according to claim 1, wherein the table and seating apparatus is configured for a user to sit on the first assembly seat bottom with the user's legs under the second assembly in a first position.

5. A table and seating apparatus according to claim 1, wherein the seat back is proximate an edge of the seat bottom, when the second assembly is in the second position.

6. A table and seating apparatus according to claim 1, wherein the first linkage legs comprise a tubular element bent to extend under the seat bottom and forming a pivot axis for the first linkage.

7. A table and seating apparatus according to claim 1, wherein the second linkage legs comprise a tubular element bent to extend under the table top and forming a pivot axis for the second linkage.

8. A table and seating apparatus according to claim 1, wherein the first linkage comprises a stop preventing the first linkage from opening beyond the first position.

9. A table and seating apparatus according to claim 8, wherein the stop comprises an element attached to the first upright frame portion limiting travel of the first linkage.

10. A table and seating apparatus according to claim 1, wherein the second linkage includes a first link connecting the frame to the leg, and wherein the first link includes a first portion offset longitudinally from a second portion.

11. A table and seating apparatus according to claim 1, wherein the leg of the second linkage is spaced longitudinally inward from the frame upright portions.

12. A table and seating apparatus according to claim 1, wherein the leg of the second linkage extends at an angle of about 10 degrees from vertical in the storage position.

13. A table and seating apparatus according to claim 1, wherein the leg of the second linkage extends to prevent tripping on the second lateral portion of the frame.

14. A table and seating apparatus according to claim 1, wherein the first assembly comprises a center leg below the seat bottom.

15. A table and seating apparatus, comprising:

a first assembly having a first flat element movable between a first position wherein the first flat element is substantially horizontal and a second position wherein the first flat element is substantially vertical;

a second assembly having a second flat element movable between a first position wherein the second flat element is substantially horizontal and a second position wherein the second flat element is substantially vertical;

a frame proximate each end of the table and seating apparatus having laterally spaced apart first and second upright frame portions, the first upright frame portion supporting the first assembly and the second upright frame portion supporting the second assembly, a lower frame portion extending laterally outward including a first lateral portion extending toward a first side beyond the first upright frame portion, and a second lateral portion extending toward a second side beyond the second upright frame portion;

rolling devices mounted to and supporting the frame;

at least one first linkage folding the first assembly, wherein the first folding linkage includes a leg supporting the seat bottom at the first position and lifts and folds the leg at the second storage position;

at least one second linkage folding the second assembly, wherein the second linkage includes a leg supporting the table at the first position and wherein the second linkage moves the leg to a position wherein a lower end of the leg is laterally outward from an upper end of the leg;

wherein the table and seating apparatus is configurable with the first flat element at the first position and the second flat element at the first position, and wherein the table and seating apparatus is configurable with the first flat element at the first position and the second flat element at the second position, and wherein the table and seating apparatus is configurable with the first flat element at the second position and the second flat element is at the second position.

* * * * *